US009683478B2

(12) United States Patent
Nagayama et al.

(10) Patent No.: US 9,683,478 B2
(45) Date of Patent: Jun. 20, 2017

(54) DISPERSION PLATE AND INTERNAL COMBUSTION ENGINE

(71) Applicants: TOYOTA JIDOSHA KABUSHIKI KAISHA, Toyota-shi, Aichi-ken (JP); SANGO CO., LTD., Miyoshi, Aichi (JP)

(72) Inventors: Tsukasa Nagayama, Toyota (JP); Naoki Yagi, Toyota (JP)

(73) Assignees: TOYOTA JIDOSHA KABUSHIKI KAISHA, Toyota (JP); SANGO CO., LTD., Miyoshi (JP)

( * ) Notice: Subject to any disclaimer, the term of this patent is extended or adjusted under 35 U.S.C. 154(b) by 0 days.

(21) Appl. No.: 14/919,307

(22) Filed: Oct. 21, 2015

(65) Prior Publication Data

US 2016/0115852 A1 Apr. 28, 2016

(30) Foreign Application Priority Data

Oct. 22, 2014 (JP) ..... 2014-215630

(51) Int. Cl.
*F01N 3/00* (2006.01)
*F01N 13/00* (2010.01)
*F02D 41/14* (2006.01)

(52) U.S. Cl.
CPC ..... *F01N 13/008* (2013.01); *F02D 41/1439* (2013.01); *F01N 2240/20* (2013.01); *F01N 2560/025* (2013.01); *F02D 41/1454* (2013.01)

(58) Field of Classification Search
USPC ..... 60/272, 286, 295, 299, 301, 303, 305, 60/323, 324
See application file for complete search history.

(56) References Cited

U.S. PATENT DOCUMENTS 8,966,887 B2 * 3/2015 Miao ..... B01F 5/0611 60/317
8,966,965 B2 * 3/2015 Driscoll ..... F01N 3/208 73/114.71

(Continued)

FOREIGN PATENT DOCUMENTS

EP 2 716 884 A1 4/2014
JP 63-121718 8/1988

(Continued)

OTHER PUBLICATIONS

Translation of Sep. 29, 2016 Office Action issued in Korean Patent Application No. 10-2015-0147187.

*Primary Examiner* — Binh Q Tran
(74) *Attorney, Agent, or Firm* — Oliff PLC

(57) ABSTRACT

A dispersion plate that can be arranged on an upstream side of an oxygen concentration sensor in an exhaust pipe of an internal combustion engine, the oxygen concentration sensor being arranged in the exhaust pipe, is provided. The dispersion plate is configured to disperse an exhaust flow in the exhaust pipe. The dispersion plate includes a first plate and a second plate. The first plate includes a deflection plate that extends in an inclined direction and a twisted direction with respect to an extending direction of the exhaust pipe. The second plate extends in a direction orthogonal to the extending direction of the exhaust pipe. The second plate includes a through hole. The second plate is arranged on an outer circumferential side of the first plate in the exhaust pipe.

9 Claims, 7 Drawing Sheets

(56) References Cited

U.S. PATENT DOCUMENTS

| | | | | |
|---|---|---|---|---|
| 9,163,548 | B2 * | 10/2015 | Henderson, IV | F01N 3/101 |
| 9,267,417 | B2 * | 2/2016 | Baldwin | F01N 13/08 |
| 2002/0110047 | A1 | 8/2002 | Bruck et al. | |
| 2012/0167557 | A1 * | 7/2012 | Itoh | F01N 3/2066 60/277 |
| 2015/0047330 | A1 * | 2/2015 | Zhang | F01N 3/28 60/311 |

FOREIGN PATENT DOCUMENTS

| | | | |
|---|---|---|---|
| JP | H05-11056 | U | 2/1993 |
| JP | H06-73320 | U | 10/1994 |
| JP | 2003-507688 | A | 2/2003 |
| JP | 2006-029233 | A | 2/2006 |
| JP | 2014-196694 | A | 10/2014 |
| WO | 2012-164722 | A1 | 12/2012 |

* cited by examiner

DISPERSION PLATE AND INTERNAL COMBUSTION ENGINE

INCORPORATION BY REFERENCE

The disclosure of Japanese Patent Application No. 2014-215630 filed on Oct. 22, 2014 including the specification, drawings and abstract is incorporated herein by reference in its entirety.

BACKGROUND OF THE INVENTION

1. Field of the Invention

The invention relates to a dispersion plate that is provided in an exhaust pipe of an internal combustion engine to disperse an exhaust flow and an internal combustion engine including the dispersion plate in the exhaust pipe.

2. Description of Related Art

An oxygen concentration sensor for detecting oxygen concentration in exhaust gas is provided in an exhaust pipe of an internal combustion engine, and the oxygen concentration in the exhaust gas serves as an index value of an air-fuel ratio of air-fuel mixture. In operation control of the internal combustion engine, an intake air amount or a fuel injection amount is adjusted in accordance with a detected value by the oxygen concentration sensor, and the air-fuel ratio of the air-fuel mixture is thereby controlled.

In addition, it has been suggested to provide a dispersion plate that disperses an exhaust flow in a portion on an exhaust upstream side of the oxygen concentration sensor in the exhaust pipe (for example, see Japanese Utility Model Application Publication No. 6-73320 (JP 6-73320 U)). This dispersion plate has a deflection plate that deflects the exhaust flow. This deflection plate extends in an inclined direction and a twisted direction with respect to an extending direction of the exhaust pipe. A swirl flow (in detail, a flow that swirls in a spiral shape in the extending direction of the exhaust pipe) is formed on the inside of the exhaust pipe by the above deflection plate. This swirl flow agitates the exhaust gas, so as to suppress fluctuation of the oxygen concentration in the exhaust gas in the exhaust pipe. Thus, detection accuracy of the oxygen concentration in the exhaust gas by the oxygen concentration sensor is increased.

SUMMARY OF THE INVENTION

Here, in order to improve the detection accuracy of the oxygen concentration in the exhaust gas by the oxygen concentration sensor, it is considered to increase a degree of agitation of the exhaust gas by the dispersion plate. However, if it is attempted to increase the degree of agitation of the exhaust gas by the dispersion plate that has the above-mentioned structure, a length of the dispersion plate (in detail, the deflection plate thereof) has to be increased in the extending direction of the exhaust pipe. This is not preferred because it results in an expanded mounting space of the dispersion plate.

The invention provides a dispersion plate and an internal combustion engine with which a high exhaust agitation effect can be obtained in a saved space.

A dispersion plate according to one aspect of the invention is provided. The dispersion plate can be arranged on an upstream side of an oxygen concentration sensor in an exhaust pipe of an internal combustion engine, the oxygen concentration sensor being arranged in the exhaust pipe. The dispersion plate is configured to disperse an exhaust flow in the exhaust pipe. The dispersion plate includes a first plate and a second plate. The first plate includes a deflection plate that extends in an inclined direction and a twisted direction with respect to an extending direction of the exhaust pipe. The second plate extends in a direction orthogonal to the extending direction of the exhaust pipe. The second plate includes a through hole. The second plate is arranged on an outer circumferential side of the first plate in the exhaust pipe.

According to the above aspect, when exhaust gas passes through the deflection plate of the first plate, a swirl flow that swirls in a spiral shape in the extending direction of the exhaust pipe is generated on an exhaust downstream side thereof. In addition, when the exhaust gas passes through the through hole of the second plate, a whirling flow, a whirling axis of which contains a whirling component in the direction orthogonal to the extending direction of the exhaust pipe, is generated on the exhaust downstream side thereof. Then, the swirl flow of the exhaust gas that is formed by the first plate is generated on an inner circumferential side of the second plate on the inside of the exhaust pipe, that is, in a portion on a central side on the inside of the exhaust pipe. The whirling flow of the exhaust gas that is formed by the second plate is generated on an outer circumferential side of the first plate, that is, in a portion on an inner wall surface side on the inside of the exhaust pipe. Accordingly, in a portion on the exhaust downstream side of the above dispersion plate on the inside of the exhaust pipe, the swirl flow and the whirling flow of the exhaust gas can collide with each other, so as to agitate the exhaust gas. Thus, a degree of agitation of said exhaust gas can be increased. Just as described, according to the above dispersion plate, there is no need to increase a length of the dispersion plate of the first plate in the above extending direction. In addition, by providing the second plate having the through hole, the degree of the agitation of the exhaust gas can be increased, and a high exhaust agitation effect can be obtained in a saved space.

In the dispersion plate according to the above aspect, the deflection plate of the first plate may be configured to generate the swirl flow that swirls in a spiral shape in the extending direction in conjunction with passing of the exhaust gas therethrough. The second plate may be configured to generate the whirling flow, the whirling axis of which contains a whirling component in the direction orthogonal to the extending direction, in conjunction with passing of the exhaust gas through the through hole.

In the dispersion plate according to the above aspect, the first plate and the second plate may be constructed integrally. According to the above aspect, the dispersion plate can be formed at low cost by pressing or the like.

In the dispersion plate according to the above aspect, the first plate and the second plate may have a shape to extend across a whole circumference of a center axis of the exhaust pipe. According to the above aspect, the swirl flow and the whirling flow of the exhaust gas can be generated for the whole circumference around the center axis in the exhaust pipe. Thus, in the exhaust pipe, the swirl flow and the whirling flow collide with each other, and the exhaust gas can thereby be agitated thoroughly. Therefore, fluctuation of the oxygen concentration in the exhaust gas can favorably be suppressed.

In the above dispersion plate, the second plate preferably includes a wall portion that rises from an inner wall surface of the exhaust pipe toward a central side on the inside of said exhaust pipe. In the case where condensed water is produced in a portion on an exhaust upstream side of the dispersion plate in the exhaust pipe, the condensed water is possibly scattered in the exhaust pipe by the above swirl flow and whirling flow and is possibly scattered on the oxygen concentration sensor. This can be a cause of performance deterioration of the oxygen concentration sensor.

According to the above dispersion plate, in the case where the condensed water that is produced in the portion on the upstream exhaust side of the dispersion plate in the exhaust pipe flows to a disposed position of said dispersion plate, the condensed water can be blocked by the wall portion of the dispersion plate. Thus, the condensed water that is produced in the exhaust pipe can be suppressed from being scattered on the oxygen concentration sensor that is disposed on the exhaust downstream side of the dispersion plate. Thus, performance deterioration of said oxygen concentration sensor can be suppressed.

An internal combustion engine according to one aspect of the invention is provided. The internal combustion engine includes plural cylinders, an exhaust pipe, an oxygen concentration sensor and a dispersion plate according to above aspect. The exhaust pipe includes plural branch portions that respectively communicate with the cylinders of the internal combustion engine and a merging portion where the plural branch portions merge. The oxygen concentration sensor is arranged in the merging portion in the exhaust pipe. The dispersion is arranged on an upstream side of an oxygen concentration sensor in the merging portion in the exhaust pipe.

In the exhaust pipe of the multi-cylinder internal combustion engine, the exhaust flow from each of the cylinders flows into the merging portion through a different path (each of the branch portions). Thus, the exhaust flow is possibly inconsistent in a different portion in the exhaust pipe. It is difficult to accurately detect oxygen concentration of such exhaust gas by the common oxygen concentration sensor provided in the merging portion of the exhaust pipe.

In regard to this point, according to the above aspect, the exhaust flow in the exhaust pipe is dispersed, and the fluctuation of the oxygen concentration in the exhaust gas can thereby be suppressed. Thus, the oxygen concentration in the exhaust gas that is discharged from each of the cylinders of the internal combustion engine can accurately be detected by the common oxygen concentration sensor provided in the merging portion of the exhaust pipe.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
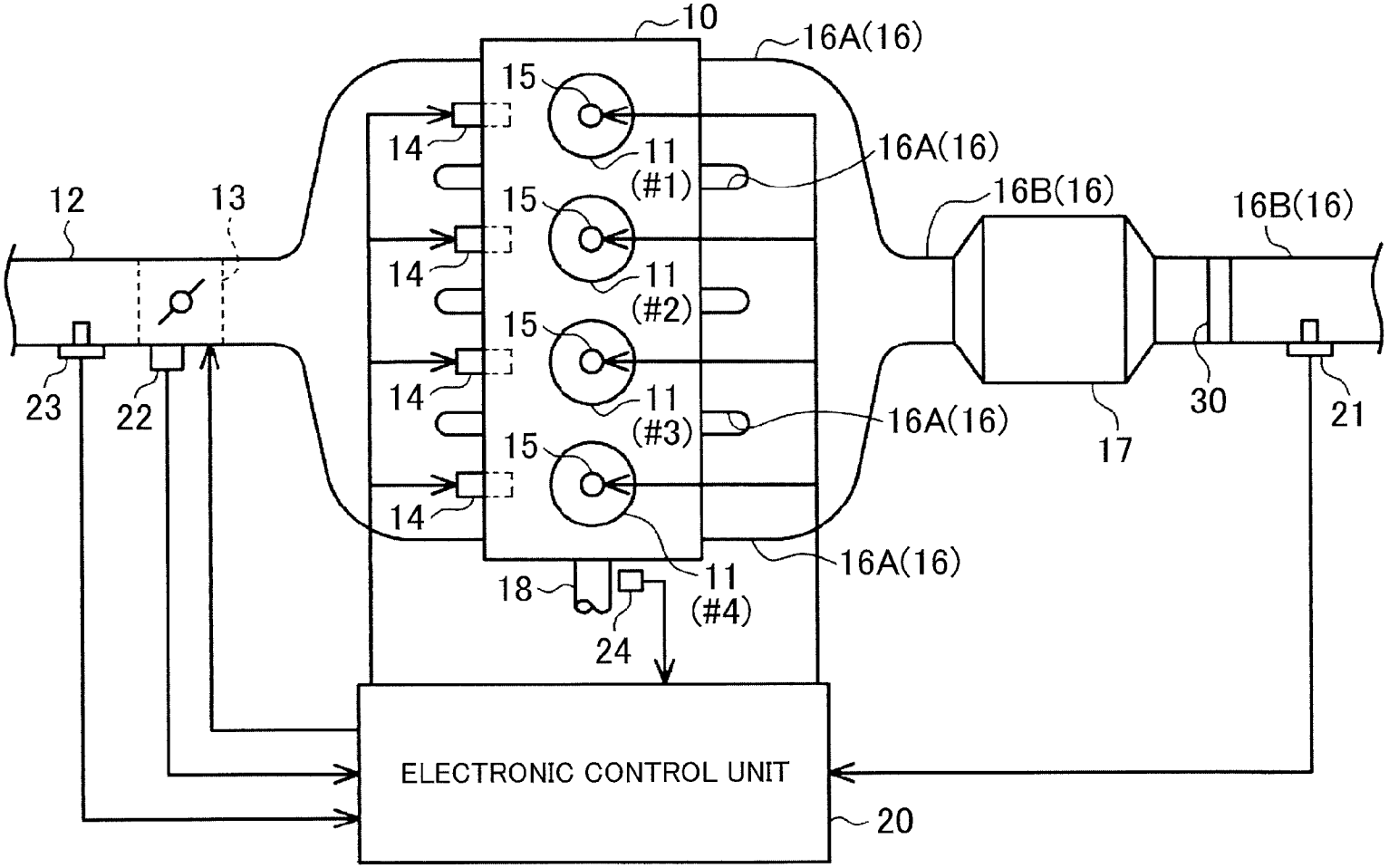
FIG. 1 is a schematic view of a schematic configuration of an engine system to which a dispersion plate of an embodiment is applied.

A description will hereinafter be made on an embodiment of a dispersion plate. As shown in FIG. 1, an internal combustion engine 10 includes plural (four in this embodiment) cylinders 11 (#1, #2, #3, #4). A throttle valve 13 is provided in an intake pipe 12 of the internal combustion engine 10. Through control of an opening degree of this throttle valve 13, an air amount that is suctioned into each of the cylinders 11 of the internal combustion engine 10 is adjusted. Air-fuel mixture contains the air that is suctioned into each of the cylinders 11 through the intake pipe 12 and fuel that is injected from a fuel injection valve 14. The air-fuel mixture is ignited by an ignition plug 15, and said air-fuel mixture is combusted. In this way, the internal combustion engine 10 is operated.

The air-fuel mixture that has been combusted in each of the cylinders 11 of the internal combustion engine 10 is delivered as exhaust gas to an exhaust pipe 16, is purified in a catalytic converter 17 that is provided in said exhaust pipe 16, and is released to the outside. The exhaust pipe 16 of the internal combustion engine 10 has: plural (four in this embodiment) branch portions 16A that respectively communicate with the cylinders 11; and a merging portion 16B where these branch portions 16A merge. The above catalytic converter 17 is provided in the merging portion 16B of the exhaust pipe 16. In addition, in a portion on an exhaust downstream side of the above catalytic converter 17 in the merging portion 16B of the exhaust pipe 16, an oxygen concentration sensor 21 that outputs a detection signal corresponding to oxygen concentration in the exhaust gas is provided.

The internal combustion engine 10 includes an electronic control unit 20 as peripheral equipment thereof that executes various types of control related to said internal combustion engine 10. This electronic control unit 20 is configured by including a CPU that performs various computation processes related to the above control, a ROM in which a program and data required for the control are stored, a RAM that temporarily stores computation results and the like of the CPU, input/output ports that are used to input/output signals from/to the outside, and the like.

In addition to the above oxygen concentration sensor 21, various sensors and the like, which are shown below, are connected to the input port of the electronic control unit 20. A throttle position sensor 22 that detects the opening degree of the throttle valve 13 (a throttle opening degree).

An airflow meter 23 that detects the air amount suctioned into the cylinders 11 of the internal combustion engine 10 through the intake pipe 12. A crank position sensor 24 that outputs a signal corresponding to rotation of a crankshaft 18 and is used to calculate an engine speed and the like.

To the output port of the electronic control unit 20, drive circuits of various equipment, such as a drive circuit of the throttle valve 13 and a drive circuit of the fuel injection valve 14, and the like are connected. On the basis of the detection signals input from the above various sensors, the electronic control unit 20 grasps an engine operation state that includes the engine speed and an engine load (the air amount suctioned into the cylinders 11 per cycle of the internal combustion engine 10). It should be noted that the engine speed is obtained on the basis of the detection signal from the crank position sensor 24. In addition, the engine load is calculated from the above engine speed and an intake air amount of the internal combustion engine 10 that is obtained on the basis of the detection signals from the throttle position sensor 22, the airflow meter 23, and the like. In accordance with the engine operation state, such as the engine load and the engine speed, the electronic control unit 20 outputs command signals to the various drive circuits that are connected to the above output port. In this way, fuel injection amount control, intake air amount control, and the like in the internal combustion engine 10 are executed through the electronic control unit 20. In the fuel injection amount control, the electronic control unit 20 executes air-fuel ratio feedback control in which a fuel injection amount is subjected to feedback control on the basis of output of the oxygen concentration sensor 21, such that an actual air-fuel ratio of the air-fuel mixture matches a desired ratio (for example, a theoretical air-fuel ratio).

A dispersion plate 30 that disperses an exhaust flow is provided in a portion between the catalytic converter 17 and the oxygen concentration sensor 21 in the exhaust pipe 16 of the internal combustion engine 10. This dispersion plate 30 suppresses inconsistency in the oxygen concentration in the exhaust gas in the exhaust pipe 16. Thus, detection accuracy of the oxygen concentration in the exhaust gas by the oxygen concentration sensor 21 is improved, and furthermore, execution accuracy of the air-fuel ratio feedback control is improved.

Figure 2:
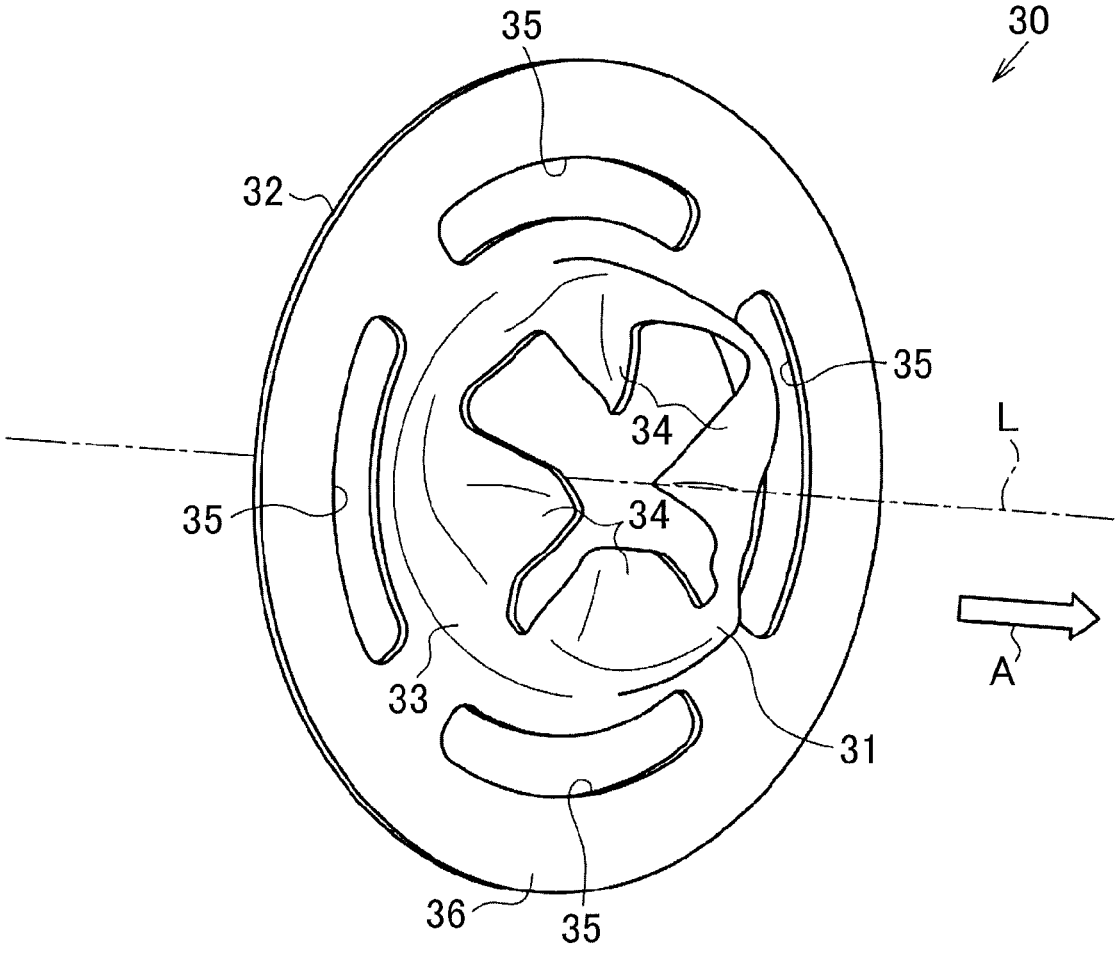
FIG. 2 is a perspective view of a perspective structure of the dispersion plate.
Figure 3B:
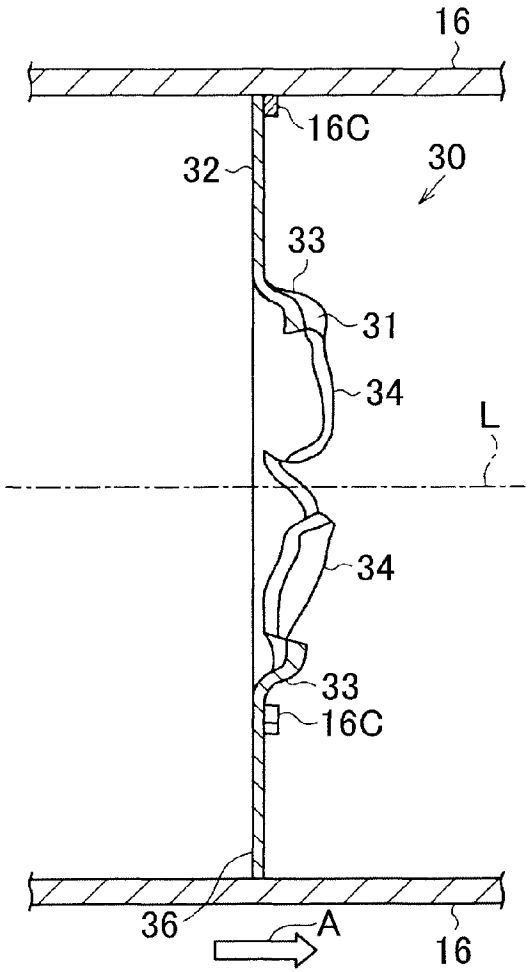
FIG. 3B is a cross-sectional view of the exhaust pipe in an extending direction.
Figure 3A:
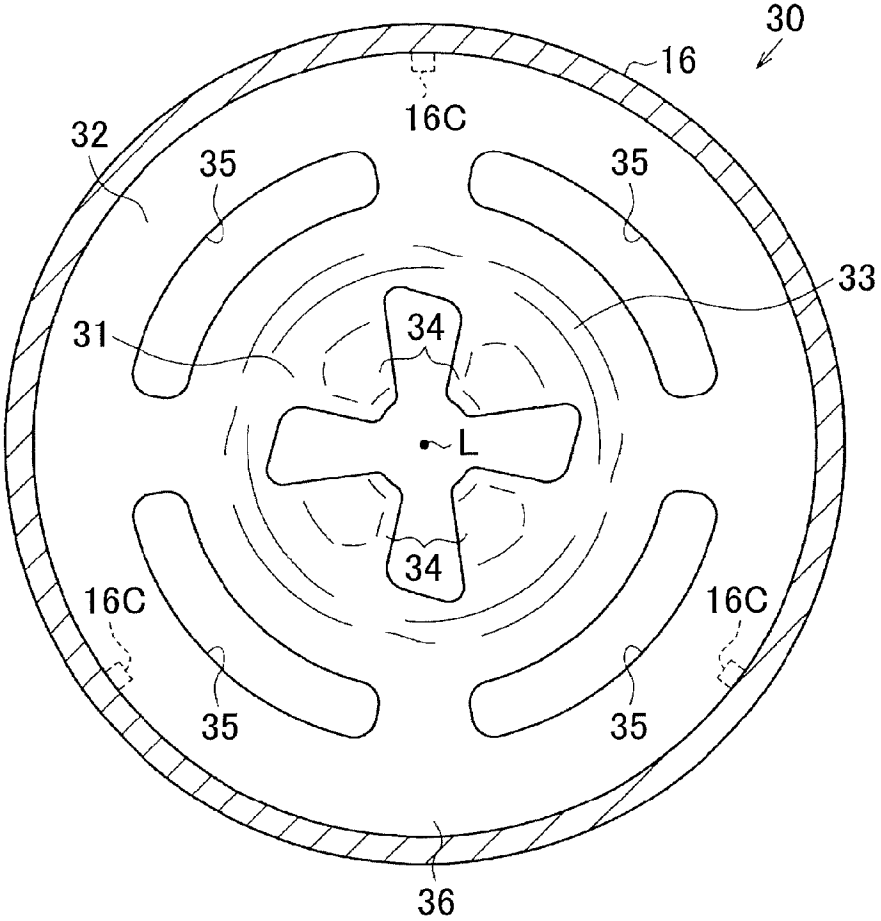
FIG. 3A is a cross-sectional view of an exhaust pipe in a radial direction.

Hereinafter, a structure of the above dispersion plate 30 will specifically be described. As shown in FIG. 2, FIG. 3A, and FIG. 3B, the dispersion plate 30 is constructed of two types of plates (a first plate 31 and a second plate 32) that extend in a direction orthogonal to an extending direction of the exhaust pipe 16 (a direction indicated by an arrow A in the drawings). This dispersion plate 30 is integrally formed by press forming in an aspect that the first plate 31 is arranged in a central portion of the ring-shaped second plate 32. Just as described, an inner circumferential portion of the dispersion plate 30 is constructed of the first plate 31, and an outer circumferential portion thereof is constructed of the second plate 32.

The above first plate 31 has a base portion 33 that extends in a substantially cylindrical shape in the above extending direction A. In addition, the first plate 31 has plural (four in this embodiment) deflection plates 34, each of which extends in an inclined direction with respect to the above extending direction A from an end on an exhaust downstream side of the base portion 33 as a starting point, and each of which extends in a twisted direction with respect to said extending direction A. These deflection plates 34 extend in the inclined direction with respect to the extending direction A such that the deflection plates 34 approach a central portion of the exhaust pipe 16 (in detail, a center axis L thereof) as they extend toward the exhaust downstream side. Furthermore, each of the deflection plates 34 is formed in substantially the same shape, and is formed in a twisted shape in the same direction around the center axis L of the exhaust pipe 16. Each of the above deflection plates 34 has such a shape that the exhaust gas that has passed therethrough generates a swirl flow (in detail, a flow that swirls in a spiral shape in the above extending direction A).

The above second plate 32 is formed in a shape of a ring-shaped flat plate as a whole, has plural (four in this embodiment) through holes 35 that extend in an arcuate shape at intervals in a circumferential direction thereof. These through holes 35 are formed in the same shape. Each of these through holes 35 has such a shape that the exhaust gas that has passed therethrough generates a whirling flow (in detail, a whirling flow, a whirling axis of which contains a large number of whirling components in a direction orthogonal to the above extending direction A).

FIG. 3A shows a cross-sectional structure of the exhaust pipe 16 in a radial direction, and FIG. 3B shows a cross-sectional structure of the exhaust pipe 16 in the extending direction A. As shown in FIG. 3A and FIG. 3B, the dispersion plate 30 is attached in such an aspect that both of the first plate 31 and the second plate 32 extend across a whole circumference around the center axis L of the exhaust pipe 16.

On the inside of the exhaust pipe 16, plural (three in this embodiment) stoppers 16C, each of which is in a shape projected from an inner wall surface, are provided at intervals in the circumferential direction. Then, the dispersion plate 30 is inserted until reaching a position where the dispersion plate 30 abuts against each of the stoppers 16C. In this state, an inner wall of the exhaust pipe 16 and an end of the second plate 32 are fixed through a welding process. In this way, the dispersion plate 30 is disposed in the exhaust pipe 16. The first plate 31 is thereby arranged in the central portion of the exhaust pipe 16, and the second plate 32 is arranged around the first plate 31. In addition, once the second plate 32 is attached to the inside of the exhaust pipe 16, a circumferential edge on the outer circumferential side thereof serves as a wall portion 36 that is provided to extend from the inner wall surface of the exhaust pipe 16 toward a central side on the inside of said exhaust pipe 16.

Figure 4:
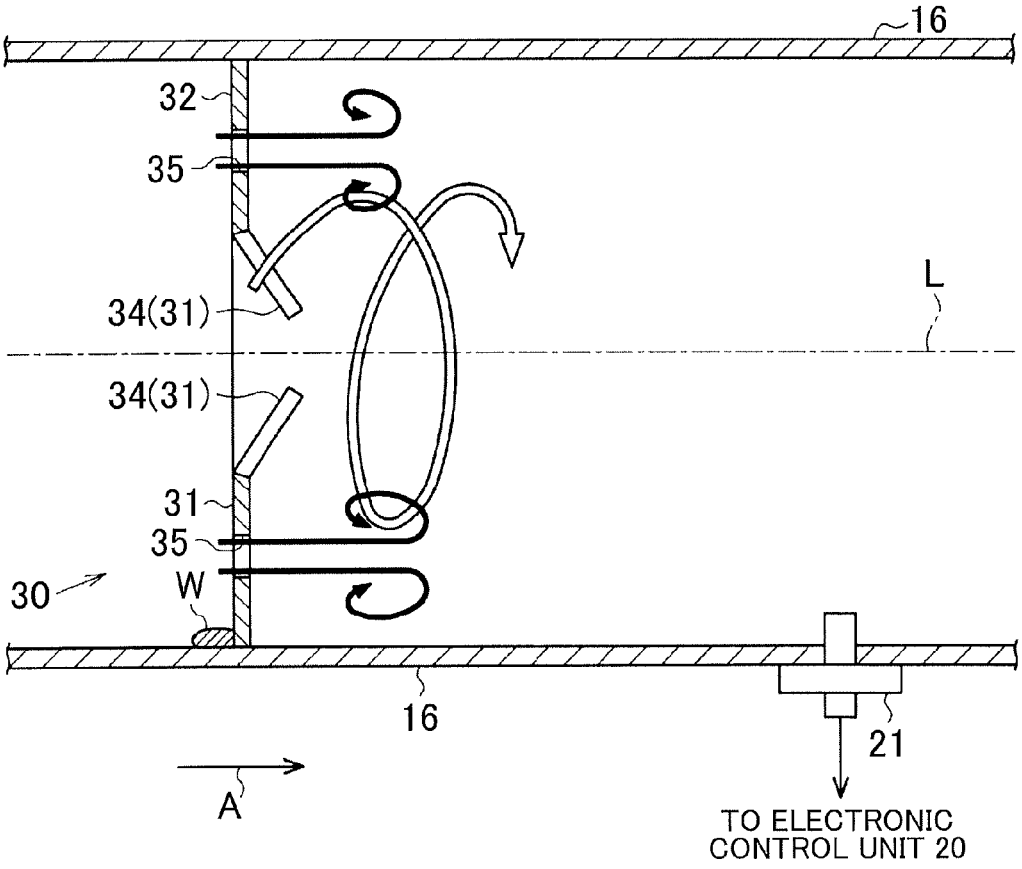
FIG. 4 is a view of an action that shows a flow of exhaust gas around the dispersion plate.

Hereinafter, actions obtained by providing the dispersion plate 30 will be described. As shown in FIG. 4, the dispersion plate 30 is disposed in the exhaust pipe 16. Thus, when the exhaust gas passes through the deflection plates 34 of the first plate 31, a swirl flow (a flow indicated by a blank arrow in the drawing) of the exhaust gas is generated in a portion on the center axis L side on the inside of the exhaust pipe 16. In addition, when the exhaust gas passes through the through holes 35 of the second plate 32, whirling flows (flows indicated by black arrows in the drawing) of the exhaust gas are generated in a portion on the inner wall surface side on the inside of the exhaust pipe 16. Accordingly, on the exhaust downstream side of the above dispersion plate 30 in the exhaust pipe 16, the swirl flow is formed in the central portion of the exhaust pipe 16, and the whirling flows are formed to surround the swirl flow. In this way, these swirl flow and whirling flows collide with each other, and the exhaust gas is agitated. A degree of agitation of the exhaust gas is thereby increased. Therefore, the oxygen concentration of the exhaust gas that is discharged from each of the cylinders 11 of the internal combustion engine 10 can accurately be detected by the oxygen concentration sensor 21 fixed to the exhaust pipe 16. In addition, the air-fuel ratio feedback control can appropriately be executed in a manner to correspond to the actual air-fuel ratio.

If it is attempted to agitate the exhaust gas only by using the deflection plates 34 of the first plate 31, which generate the swirl flow in the exhaust pipe 16, a length of each of the deflection plates 34 of the exhaust pipe 16 in the extending direction A has to be increased in order to increase the degree of the agitation of the exhaust gas. This is not preferred because it results in an expanded mounting space of the dispersion plate.

Figure 5:
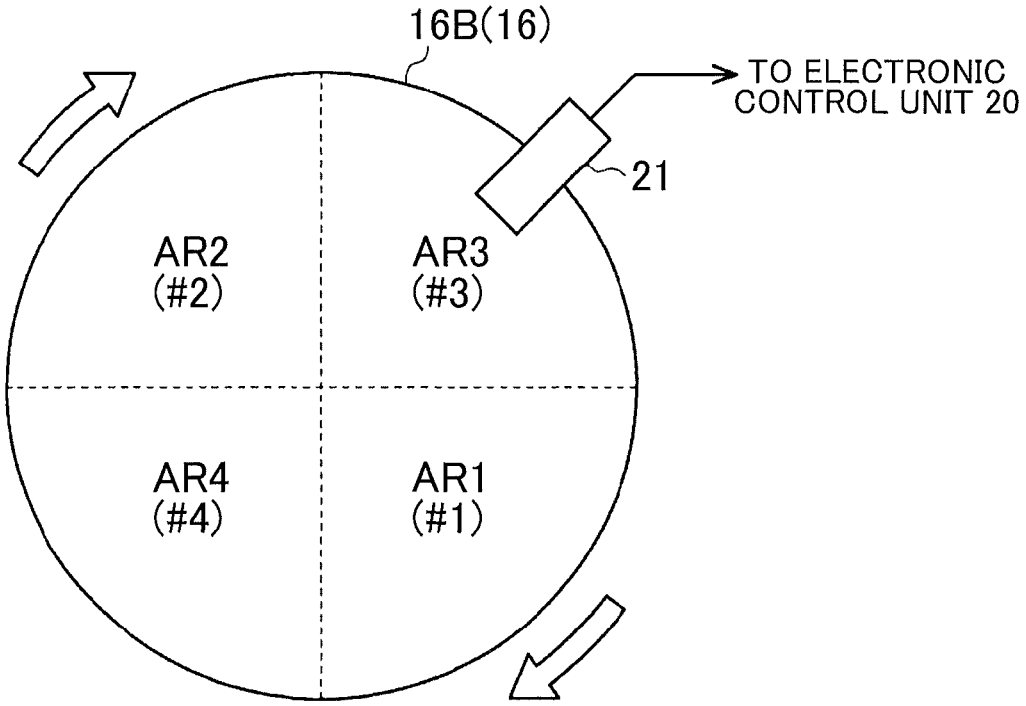
FIG. 5 is a schematic view of inconsistency of an exhaust flow in an exhaust pipe.

In addition, in the above exhaust pipe 16, the exhaust flow from each of the cylinders 11 of the internal combustion engine 10 flows into the merging portion 16B thereof (FIG. 1) through the different path (each of the branch portions 16A). Thus, as one example is shown in FIG. 5, the exhaust flow from each of the cylinders 11 of the internal combustion engine 10 possibly becomes inconsistent in different portions in the exhaust pipe 16. In FIG. 5, a region AR1 is a portion through which the exhaust gas of the cylinder 11#1 is likely to pass, a region AR2 is a portion through which the exhaust gas of the cylinder 11#2 is likely to pass, a region AR3 is a portion through which the exhaust gas of the cylinder 11#3 is likely to pass, and a region AR4 is a portion through which the exhaust gas of the cylinder 11#4 is likely to pass. It is difficult to accurately detect the oxygen concentration of the exhaust gas with such inconsistency by the common oxygen concentration sensor 21 that is provided in the merging portion 16B of the exhaust pipe 16.

In addition, the above deflection plates 34 deflect the exhaust flow so as to make it the swirl flow. Accordingly, even when the exhaust gas is agitated only by using the deflection plates 34, an inconsistent portion of the exhaust flow is merely shifted in the circumferential direction of the exhaust pipe 16 (a direction indicated by blank arrows in the drawing). Thus, the inconsistency of the exhaust flow in the exhaust pipe 16 is not possibly eliminated. As long as such inconsistency of the exhaust flow is present, it is difficult to accurately detect the oxygen concentration of the exhaust gas of each of the cylinders 11 by the oxygen concentration sensor 21.

In regard to this point, as shown in FIG. 3A, FIG. 3B, and FIG. 4, the second plate 32 (in detail, the through holes 35 thereof) for generating the whirling flows is provided, in addition to the deflection plates 34 for generating the swirl flow, in the above dispersion plate 30. Accordingly, there is no need to increase the length of each of the deflection plates 34 of the first plate 31 in the extending direction A of the exhaust pipe 16, and by providing the second plate 32 with the through holes 35, the degree of the agitation of the exhaust gas in the exhaust pipe 16 can be increased, and a high exhaust agitation effect can be obtained in a saved space.

In addition, the swirl flow and the whirling flows are generated and collide with each other in the exhaust pipe 16. In this way, the exhaust flow can be dispersed. Thus, fluctuation of the oxygen concentration of the exhaust gas can be suppressed by suppressing the inconsistency of the exhaust flow from each of the cylinders 11 of the internal combustion engine 10. Furthermore, the oxygen concentration of the exhaust gas, which is discharged from each of the cylinders 11 of the internal combustion engine 10, can accurately be detected by the common oxygen concentration sensor 21 provided in the merging portion 16B of the exhaust pipe 16.

Moreover, condensed water is possibly produced in a portion on an exhaust upstream side of the dispersion plate 30 in the exhaust pipe 16. In such a case, the condensed water is possibly scattered in the exhaust pipe 16 by the above swirl flow and whirling flows and is possibly scattered on the oxygen concentration sensor 21. This can be a cause of performance deterioration of the oxygen concentration sensor 21.

As shown in FIG. 4, in the case where condensed water W that is produced in the portion on the exhaust upstream side of the dispersion plate 30 on the inside of the above exhaust pipe 16 flows to a disposed position of said dispersion plate 30, the condensed water W is blocked by the wall portion 36 of the dispersion plate 30. Then, this blocked condensed water W is eventually evaporated by the high-temperature exhaust gas and disappears. Just as described, the condensed water W that is produced in the exhaust pipe 16 can be suppressed from being scattered in said exhaust pipe 16, and can also be suppressed from being scattered on the oxygen concentration sensor 21 that is disposed on the exhaust downstream side of the dispersion plate 30. Thus, the performance deterioration of the oxygen concentration sensor 21 that is caused by the condensed water produced in the exhaust pipe 16 can be suppressed by providing the dispersion plate 30.

As it has been described so far, the following effects can be obtained according to this embodiment. (1) The dispersion plate 30 that includes: the first plate 31 having the deflection plates 34; and the second plate 32 having the through holes 35 is provided. Then, the portion on the inner circumferential side of the dispersion plate 30 is constructed of the first plate 31, and the portion on the outer circumferential side of the dispersion plate 30 is constructed of the second plate 32. Thus, there is no need to increase the length of each of the deflection plates 34 of the first plate 31 in the extending direction A of the exhaust pipe 16, and by providing the second plate 32 with the through holes 35, the degree of the agitation of the exhaust gas in the exhaust pipe 16 can be increased, and the high exhaust agitation effect can be obtained in the saved space.

(2) The swirl flow can be generated in conjunction with passing of the exhaust gas through the deflection plates 34 of the first plate 31, and the whirling flows can be generated in conjunction with passing of the exhaust gas through the through holes 35 of the second plate 32.

(3) The first plate 31 and the second plate 32 are structured to be integrally formed. Thus, the dispersion plate 30 can be formed at low cost through pressing. (4) The first plate 31 and the second plate 32 are in the shape that extends across the whole circumference around the center axis L of the exhaust pipe 16. Accordingly, the swirl flow and the whirling flows of the exhaust gas can be generated for the whole circumference around the center axis L in the exhaust pipe 16. In this way, in the exhaust pipe 16, the swirl flow and the whirling flows collide with each other, and the exhaust gas can thereby be agitated thoroughly. Thus, the fluctuation of the oxygen concentration in the exhaust gas can favorably be suppressed.

(5) The fluctuation of the oxygen concentration in the exhaust gas can be suppressed by dispersing the exhaust flow in the exhaust pipe 16. Thus, the oxygen concentration in the exhaust gas that is discharged from each of the cylinders 11 of the internal combustion engine 10 can accurately be detected by the common oxygen concentration sensor 21 provided in the merging portion 16B of the exhaust pipe 16.

(6) The circumferential edge on the outer circumferential side of the second plate 32 serves as the wall portion 36 that extends from the inner wall surface of the exhaust pipe 16 toward the central side on the inside of said exhaust pipe 16. Thus, the performance deterioration of the oxygen concentration sensor 21 that is caused by the condensed water produced in the exhaust pipe 16 can be suppressed.

It should be noted that the above embodiment may be modified and implemented as follows. • A plate in an arbitrary shape can be adopted as the second plate 32. For example, instead of adopting the plate in the flat plate shape, a plate in a tapered shape, an inner diameter of which is decreased toward the exhaust downstream side, can be adopted.

Figure 6:
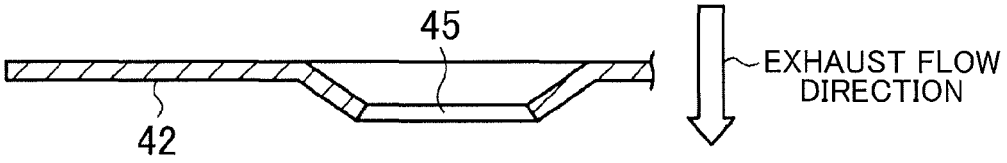
FIG. 6 is a cross-sectional view of a cross-sectional structure of a through hole of a dispersion plate of another embodiment and a circumference thereof.
Figure 7:
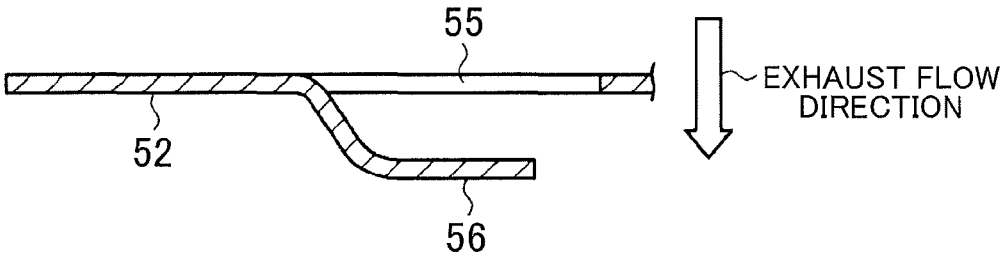
FIG. 7 is a cross-sectional view of a cross-sectional structure of a through hole of a dispersion plate of yet another embodiment and a circumference thereof.

As the second plate 32, for example, like a plate shown in FIG. 6 and a plate shown in FIG. 7, a plate in such a shape that an inner edge portion of the through hole is curved (or bent) can be adopted. A second plate 42 shown in FIG. 6 has such a shape that an inner edge portion of a through hole 45 is inclined so that a distance between opposing surfaces is reduced as the inner edge portion approaches the exhaust downstream side. In addition, a second plate 52 shown in FIG. 7 has a baffle 56 that is in a shape to extend from an inner edge portion of a through hole 55 as a starting point and that is also in a shape to cover a portion of an opening of said through hole 55. By adopting any of such second plates, a structure that allows the exhaust gas to easily pass through the through hole is adopted. In this way, flow path resistance of the dispersion plate can be reduced, and flow intensity of the whirling flow formed by the through hole can be increased.

When the dispersion plate is arranged on the inside of the exhaust pipe 16, the circumferential edge on the outer circumferential side of said dispersion plate does not have to serve as the wall portion that extends from the inner wall surface of the exhaust pipe 16 toward the central side on the inside of said exhaust pipe 16. More specifically, for example, the dispersion plate 30 may be provided at a seam of the exhaust pipe 16. Then, the inner surface of the through hole 35 of the second plate 32 may be the same surface as the inner wall surface of the exhaust pipe 16, or the inner surface of the through hole 35 of the second plate 32 may be positioned on a radially outer side of the inner wall surface of the exhaust pipe 16.

The dispersion plate is not limited to be integrally formed by pressing, but may integrally be formed by joining plural separately formed members by welding or the like. An example of such a dispersion plate is shown in FIG. 8A and FIG. 8B.

Figure 8B:
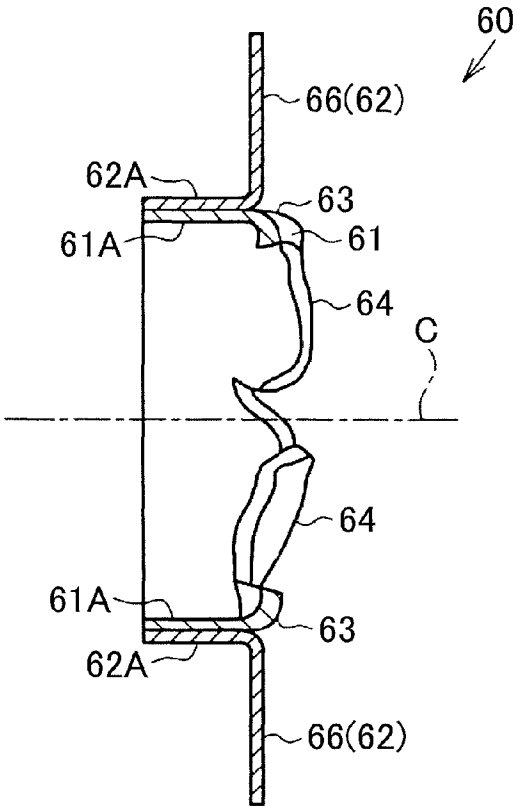
FIG. 8B is a cross-sectional view of the dispersion plate of further another embodiment.
Figure 8A:
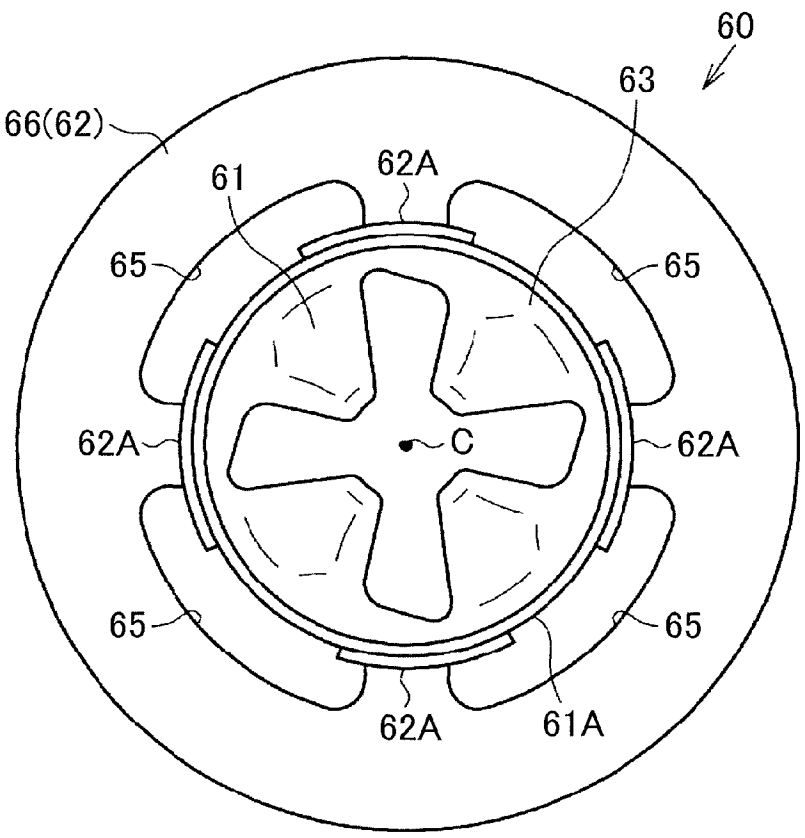
FIG. 8A is a side view of a dispersion plate of further another embodiment.

As shown in FIG. 8A and FIG. 8B, a dispersion plate 60 has: an inner member 61 that is arranged on a center axis C side thereof; and an outer member 62 that is arranged at a position to surround a circumference of said inner member 61.

The above inner member 61 has: a joined wall portion 61A that extends in a cylindrical shape with the above center axis C being a center; a base portion 63 that extends in a substantially cylindrical shape from an end on the exhaust downstream side of said joined wall portion 61A; and plural (four in the example shown in FIG. 8A, FIG. 8B) deflection plates 64, each of which extends from an end on the exhaust downstream side of the base portion 63 as a starting point. It should be noted that these joined wall portion 61A, base portion 63, and deflection plates 64 are formed integrally.

The above outer member 62 has a plate portion 66 in a shape of a ring-shaped flat plate. On a radially inner side of this plate portion 66, a plurality of (four in the example shown in FIG. 8A, FIG. 8B) notches 65, each of which extends in an arcuate shape with the above center axis being the center are formed at intervals. In addition, a joined wall portion 62A that is in an arcuate shape with the above center axis C being the center and that extends in said center axis C direction is integrally formed at each of tips that is a portion between the two notches 65 in the plate portion 66.

Then, an outer wall of the joined wall portion 61A of the inner member 61 is joined to an inner wall of each of the joined wall portions 62A of the outer member 62 by welding or the like, so as to form the outer member 62 and the inner member 61 in an integrated manner. In this dispersion plate 60, the outer member 62 and a portion of the base portion 63 of the inner member 61 correspond to the first plate, a through hole that is constructed of the notch 65 of the outer member 62 and an outer surface of the inner member 61 corresponds to the through hole for generating the whirling flow of the exhaust gas, and another portion of the base portion 63 of the inner member 61 and each of the deflection plates 64 correspond to the first plate.

The first plate that is formed with the deflection plates 34 in the central portion thereof and the second plate that is formed with the through holes 35 in the circumferential edge portion thereof may separately be formed and may be arranged on the inside of the exhaust pipe 16. In this case, the first plate and the second plate can be disposed not only in a state that the first plate and the second plate are arranged at intervals in the extending direction A of the exhaust pipe 16 but also in a state that the first plate and the second plate are placed on one another in said extending direction A.

The first plate and the second plate may not only be formed in the shape to extend across the whole circumference around the center axis of the exhaust pipe 16 but may also be formed in a shape to extend in a fan shape (or an arcuate shape) around the center axis. That is, the first plate and the second plate only need to be arranged in such an aspect that the swirl flow that is generated in conjunction with passing of the exhaust gas through the deflection plate of the first plate is generated on the central side on the inside of the exhaust pipe from the whirling flow that is generated in conjunction with passing of the exhaust gas through the through hole of the second plate.

The dispersion plate of the above embodiment can also be applied to an internal combustion engine with one to three cylinders and to an internal combustion engine with five or more cylinders.

What is claimed is:

1. A dispersion plate configured to be arranged on an upstream side of an oxygen concentration sensor in an exhaust pipe of an internal combustion engine, the oxygen concentration sensor being arranged in the exhaust pipe, and the dispersion plate being configured to disperse an exhaust flow in the exhaust pipe, the dispersion plate comprising:

a first plate including a deflection plate that (i) extends in an inclined direction that is inclined relative to an extending direction of the exhaust pipe and (ii) has a twisted shape; and a second plate extending in a main plane orthogonal to the extending direction of the exhaust pipe, the second plate including a through hole, and the second plate being arranged on an outer circumferential side of the first plate in the exhaust pipe.

2. The dispersion plate according to claim 1, wherein:

the deflection plate of the first plate is configured to generate a swirl flow that swirls in a spiral shape in the extending direction in conjunction with passing of exhaust gas through the deflection plate, and the second plate is configured to generate a whirling flow in conjunction with passing of the exhaust gas through the through hole, a whirling axis of the whirling flow containing a whirling component in the direction orthogonal to the extending direction.

3. The dispersion plate according to claim 1 wherein the first plate and the second plate are constructed integrally.

4. The dispersion plate according to claim 1, wherein the first plate and the second plate have a shape extending across a whole circumference of a center axis of the exhaust pipe.

5. The dispersion plate according to claim 1, wherein the second plate includes a wall portion that extends from an inner wall surface of the exhaust pipe toward a central side on the inside of said exhaust pipe.

6. An internal combustion engine comprising:

plural cylinders;

an exhaust pipe including plural branch portions that respectively communicate with the cylinders of the internal combustion engine and a merging portion where the plural branch portions merge;

an oxygen concentration sensor arranged in the merging portion in the exhaust pipe; and a dispersion plate according to claim 1 arranged on an upstream side of the oxygen concentration sensor in the merging portion in the exhaust pipe.

7. The dispersion plate according to claim 1, wherein the twisted shape is twisted about an axis that traverses a center axis of the exhaust pipe.

8. The dispersion plate according to claim 1, wherein the second plate includes a wall portion that extends continuously around an entire circumference of the second plate.

9. The dispersion plate according to claim 8, wherein the wall portion is positioned on an outer circumferential side of the through hole.

* * * * *